US006415481B1

(12) United States Patent
Lackler

(10) Patent No.: US 6,415,481 B1
(45) Date of Patent: Jul. 9, 2002

(54) SQUEAKLESS FURNITURE SPRING ANCHOR CLIP

(75) Inventor: Paul W. Lackler, Elmhurst, IL (US)

(73) Assignee: Stanley Fastening Systems, L.P., New Britain, CT (US)

( * ) Notice: Subject to any disclaimer, the term of this patent is extended or adjusted under 35 U.S.C. 154(b) by 0 days.

(21) Appl. No.: 09/169,179

(22) Filed: Oct. 8, 1998

Related U.S. Application Data

(60) Provisional application No. 60/061,423, filed on Oct. 8, 1997.

(51) Int. Cl.[7] ..... B65D 71/06; A47C 23/00

(52) U.S. Cl. ..... 24/350; 297/452.52; 24/347

(58) Field of Search ..... 24/347, 350, 380, 24/395; 297/452.49, 452.5, 452.52, 452.54

(56) References Cited

U.S. PATENT DOCUMENTS 3,213,926 A * 10/1965 Seckerson ..... 24/350 X
4,062,087 A * 12/1977 Lingle ..... 24/347 X
4,153,959 A * 5/1979 Omley ..... 24/350 X
4,454,636 A * 6/1984 Pearson ..... 24/347
4,935,998 A * 6/1990 Frazier et al. ..... 24/350
5,542,775 A * 8/1996 Bechtoldt et al. ..... 24/350 X
5,833,064 A * 11/1998 Ayers et al. ..... 4/350 X

* cited by examiner

*Primary Examiner*—Robert J. Sandy
(74) *Attorney, Agent, or Firm*—Fitch, Even, Tabin & Flannery

(57) ABSTRACT

A clip for securing furniture springs to furniture rails is provided including a body of metal material having a generally flat base portion for engaging the rail and a spring supporting portion extending out from the base portion and which curves back thereover to an edge thereof for maintaining a portion of a furniture spring in a substantially predetermined position relative to the rail. A plastic liner is secured to the curved spring supporting portion of the body for engaging the spring portion to minimize squeaking caused by metal-to-metal contact between the curved spring supporting portion of the clip body and the spring portion. At least one liner holding member is struck from the metal material of the curved spring supporting portion of the body and spaced from the edge thereof for keeping the liner against the curved spring supporting portion of the clip body.

9 Claims, 6 Drawing Sheets

Fig. 1
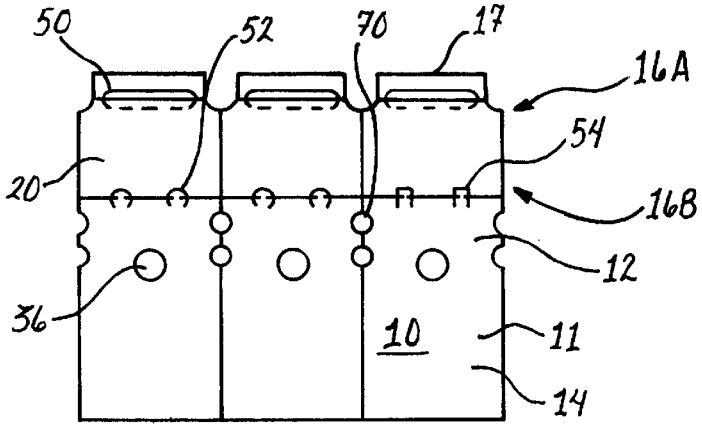
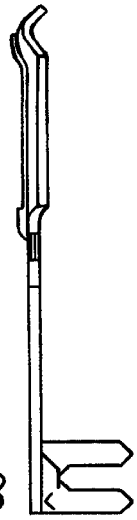
Fig. 1B
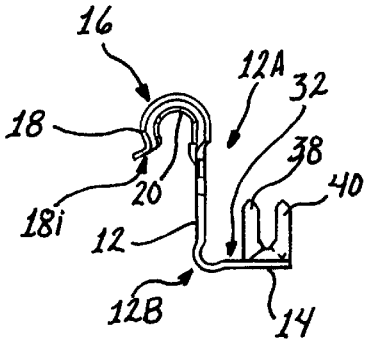
Fig. 1C
Fig. 1A
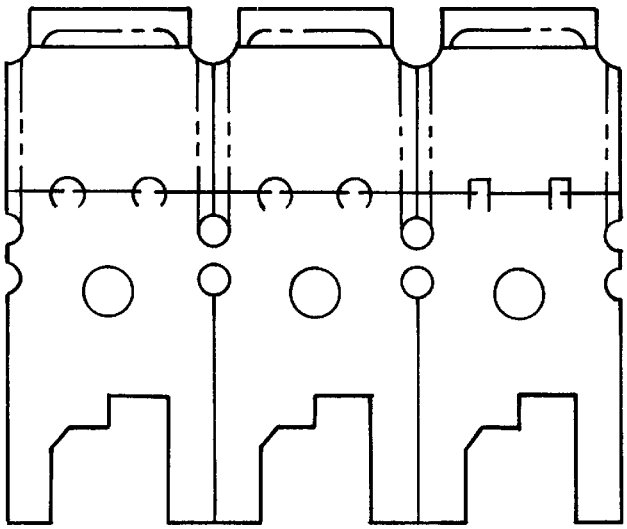

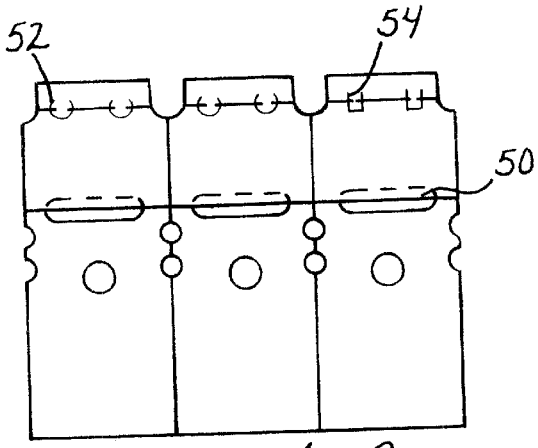
Fig. 2
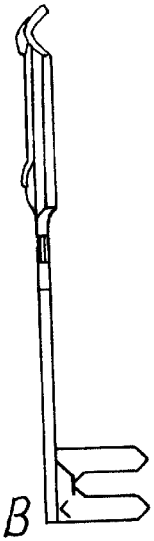
Fig. 2B
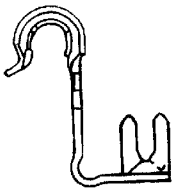
Fig. 2C
Fig. 2A
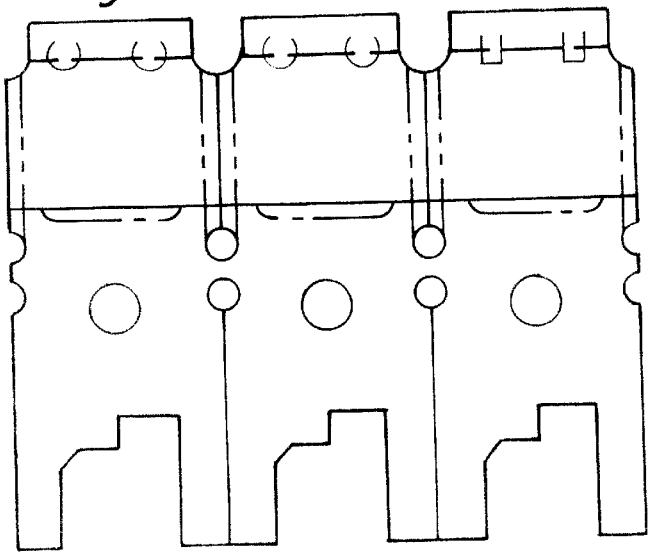

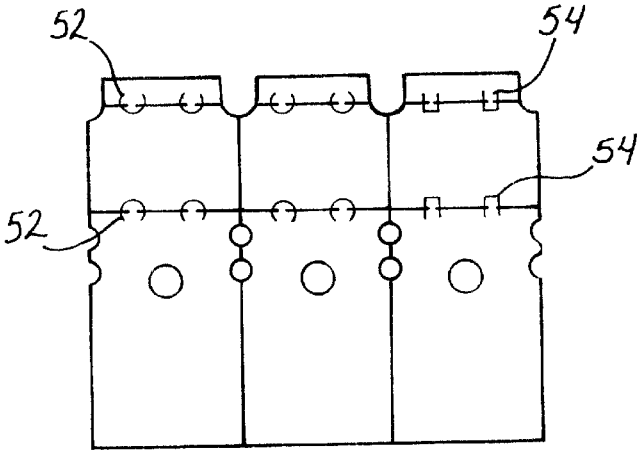
Fig.3
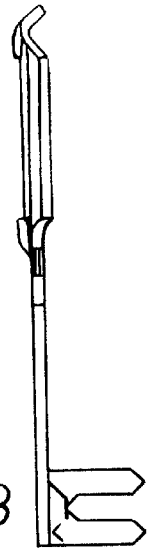
Fig.3B
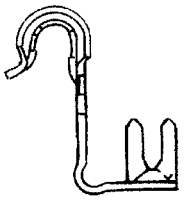
Fig.3C
Fig.3A
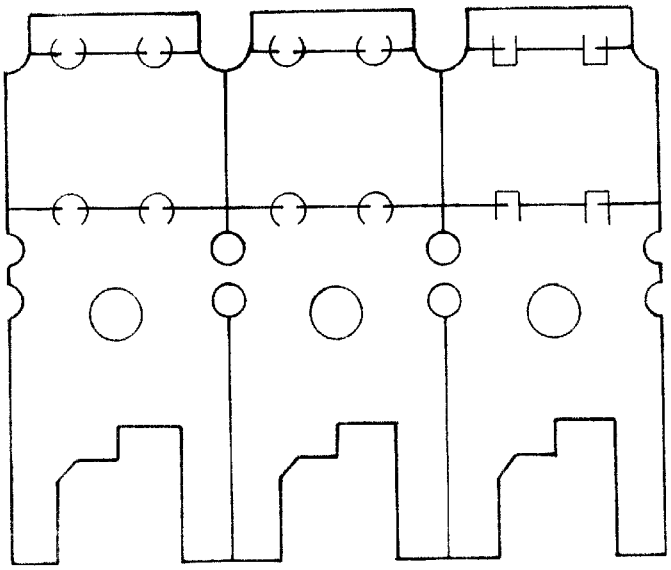

Fig. 4
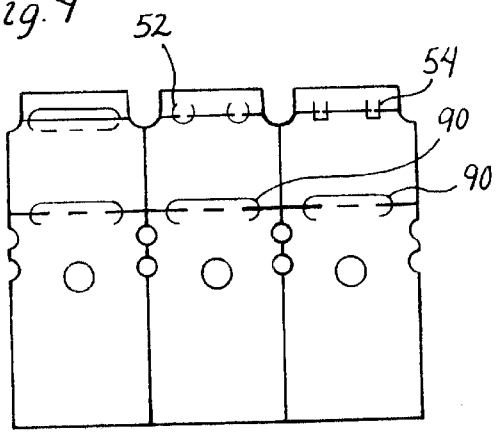
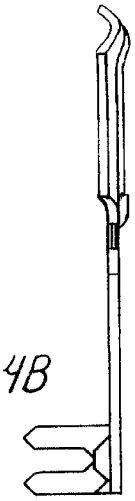
Fig. 4B
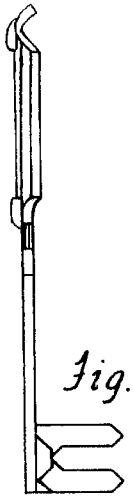
Fig. 4D
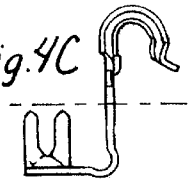
Fig. 4C
Fig. 4A
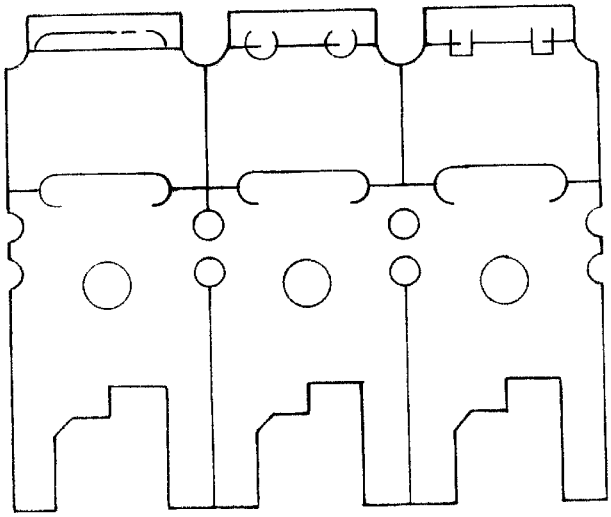
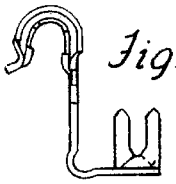
Fig. 4E Fig.5
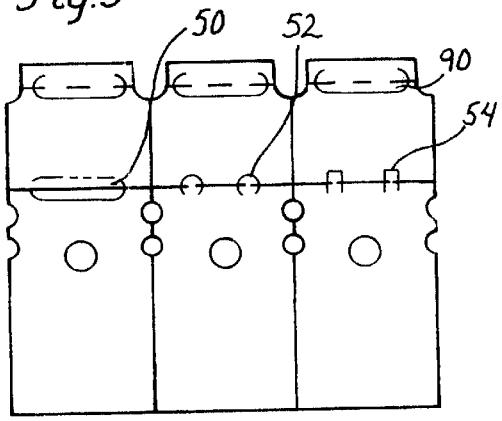
Fig.5C
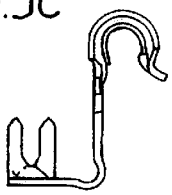
Fig.5B
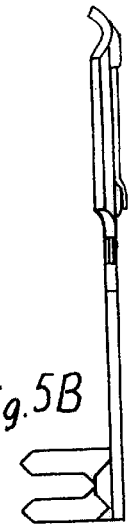
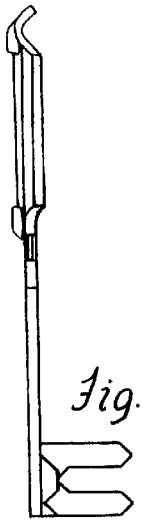
Fig.5D
Fig.5A
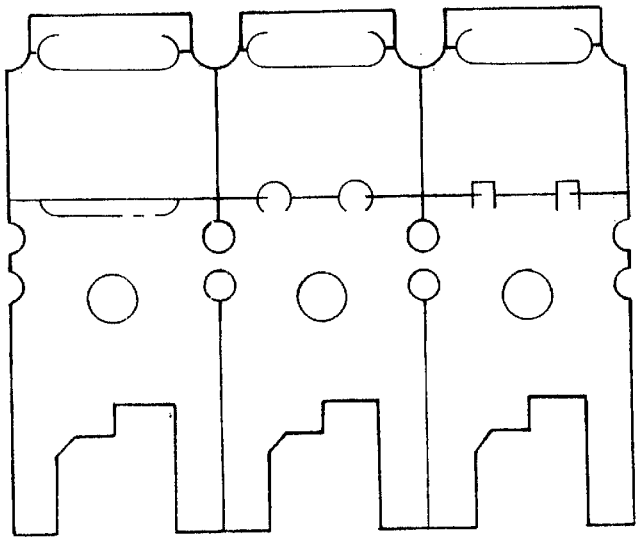
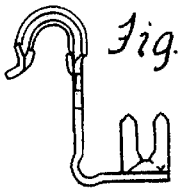
Fig.5E Fig. 6
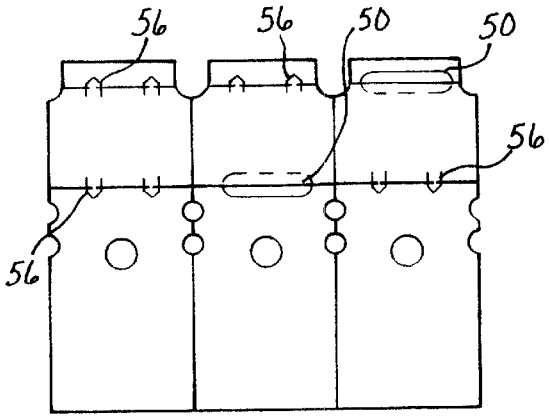
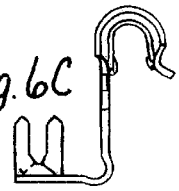
Fig. 6C
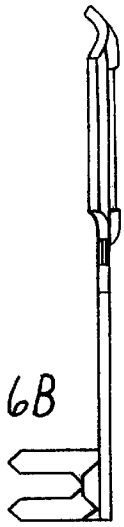
Fig. 6B
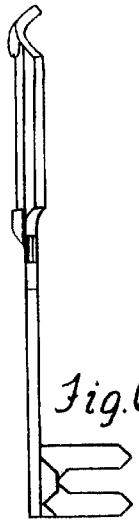
Fig. 6D
Fig. 6A
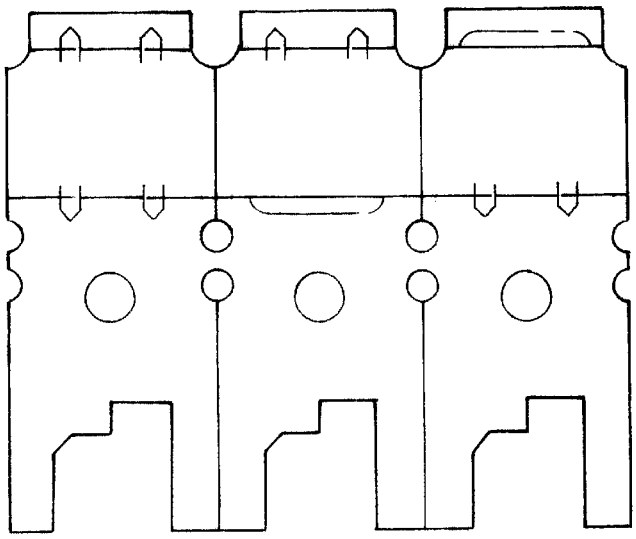
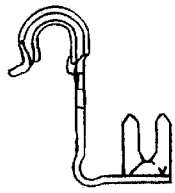
Fig. 6E

SQUEAKLESS FURNITURE SPRING ANCHOR CLIP

This appln claims benefit of Prov. No. 60/061,423 filed Oct. 8, 1997.

FIELD OF THE INVENTION

The invention is concerned with an anchor clip for fastening one member to another, and more particularly with an anchor clip for securing a supporting spring arrangement of a seat or back cushion in an article of furniture.

In general anchor clips are well known for securing furniture springs to the furniture rails which form the framework of an article of furniture. The framework typically includes four elongated furniture rails joined as a rectangle. Corresponding anchor clips are secured by means of staples or depending legs to respective, opposing sides of the rails. The anchor clips typically terminate at one end with a generally curved spring receiving portion. Opposing end portions of a bowed sinuous furniture spring extend between the opposing rails and are secured to the anchor clips within the spring receiving portion. The spring presents a generally inward directed spring force on each of the respective opposing rails via the anchor clips.

DESCRIPTION OF THE RELATED ART

Various improvements in anchor clips have been made, but a problem common to all of them is squeaking. The foregoing problem was solved to some extent by incorporating a plastic liner on the interior surface of the hook. However, due to improper installation of the spring and/or clip, and also due to spring irregularities, the liner would sometimes become ineffective, or in the alternative, the liner failed to remain permanently in place within the hook. In an attempt to overcome these shortfalls, an anchor clip was introduced which was made entirely from a plastic material. However, this plastic clip had two distinct disadvantages: it required a metal fastener for securing it to the rail of the furniture; and also, it suffered from a lack of strength. Furthermore, securing the plastic anchor clip to the furniture involved an additional operational step since it required the implementation of a nail to attach it to the frame, as opposed to an anchor clip made of steel which has an integral attachment means.

SUMMARY OF THE INVENTION

It is an object of the invention to provide an anchor clip for securing an end of a furniture spring to a rail comprising the frame of an article of furniture.

Another object of the invention is to provide a squeakless anchor clip having a plastic liner permanently secured to a hook portion of the anchor clip.

According to the invention, the anchor clip presented herein all generally comprise a base portion, a leg portion, and a reversed curved portion. The base portion is adapted to sit on top of the furniture rail, the reversed curved portion defines a hook for engaging a portion of the spring, while the leg portion is provided with a leg or prong that is driven into the side of the rail for attaching the clip thereto.

More specifically, presented herein are anchor clips for securing an end of an upholstery spring to a rail comprising the frame of an article of furniture, the clip having a base portion adapted to over hang and be completely supported by the upper surface of the rail. A rail-engaging leg portion is integrally joined to one side of the base portion, the leg portion having integral anchoring means in the form of a leg or prong adapted to be embedded into the rail for securing the anchor clip to the side of the rail. A reversed curved portion is integrally joined to the other side of the base portion for receiving the end of an upholstery spring and is adapted to be wrapped thereover. The reversed curved portion is supported on the upper surface of the rail and the base portion.

The present invention consists of a fold means for mechanically holding a plastic liner securely within the hook portion of the anchor clip. The fold means has a variety of shapes and combinations to securely hold the opposite ends of the plastic liner.

In one embodiment, a plastic liner is secured within the hook portion of the anchor clip by means of a folded tab formed along the outer-most region of the hook portion which is located farthest from the base portion. A plurality of semi-circular prongs are punched out on the innermost region of the hook, closest to the base portion. The tab and prongs are bent over the plastic liner to secure the plastic liner to the hook. In a variation to this embodiment, the semi-circular prongs may be prongs of a square configuration.

In another embodiment, a plurality of the semi-circular prongs are formed along the outer-most region of the hook, while the folded tab lies along substantially the entire innermost region of the hook closest to the base portion. In a variation to this embodiment, a plurality of squared prongs are located at the outermost region of the hook and a folded tab forms substantially the entire length of the innermost region of the hook nearest the base. In another variation, a folded tab is formed along the entire edge of both the outermost and innermost regions.

In a third embodiment, a plurality of semi-circular prongs are formed along the outermost region of the hook and additionally are formed along the innermost region of the hook. In a variation to the third embodiment, a plurality of squared prongs are located along the outermost region of the hook and along the innermost region of the hook.

In a fourth embodiment, a plurality of pointed prongs are located along both the outermost and innermost regions of the hook. The prongs may be simply folded downwardly over the edges, or the prongs may penetrate through the lining and then be pressed down. A variation to this fourth embodiment provides a plurality of pointed prongs at the outermost region of the hook and a folded tab at an innermost region of the hook. Still another variation to this fourth embodiment provides a plurality of pointed prongs at the innermost region of the hook while a folded tab is provided along the edge of the outermost region of the hook.

This invention as set out in the foregoing clip embodiments is also concerned with a method of preparing a series of said anchor clips which are interconnected together by integrally connecting bands.

In the method of the first embodiment, the method includes the steps of uncoiling a steel strip, binding a liner, which may be a plastic strip, to the steel band using adhesive or mechanical means, sending the strip to a multi-stage die for slitting the strip to form separate clip sections, folding and staking an end of each of the clip sections, punching of separating and indexing holes, punching of leg holes, forming strengthening ridges, forming the legs, and forming the hook and base portions.

It is to be noted that the liner may also be fed directly into the die for attachment.

Other features and advantages of the invention will be apparent from the following specification taken in conjunction with the following drawings.

BRIEF DESCRIPTION OF THE DRAWINGS

FIG. 1 is a top view of a series of interconnected anchor clip sections in accordance with the first embodiment of the present invention;

FIG. 1A is a view similar to FIG. 1 showing a lower cut out portion in the clip sections to form prongs for being driven into a furniture rail;

FIG. 1B is a side elevational view of one of the clip sections shown in FIG. 1A;

FIG. 1C is a side elevational view of a formed anchor clip from the clip section of FIG. 1B in accordance with the first embodiment of the present invention;

FIG. 2 is a top view of a series of interconnected anchor clip sections in accordance with the second embodiment of the present invention;

FIG. 2A is a view similar to FIG. 2 showing a lower cut out portion in the clip sections to form prongs for being driven into a furniture rail;

FIG. 2B is a side elevational view of one of the clip sections shown in FIG. 2A;

FIG. 2C is a side elevational view of a formed anchor clip from the clip section of FIG. 2B in accordance with the second embodiment of the present invention;

FIG. 3 is a top view of a series of interconnected anchor clip sections in accordance with the third embodiment of the present invention;

FIG. 3A is a view similar to FIG. 3 showing a lower cut out portion in the clip sections to form prongs for being driven into a furniture rail;

FIG. 3B is a side elevational view of one of the clip sections shown in FIG. 3A;

FIG. 3C is a side elevational view of a formed anchor clip from the clip section of FIG. 3B in accordance with the third embodiment of the present invention;

FIG. 4 is a top view of a series of interconnected anchor clip sections in accordance with the fourth embodiment of the present invention;

FIG. 4A is a view similar to FIG. 4 showing a lower cut out portion in the clip sections to form prongs for being driven into a furniture rail;

FIG. 4B is a side elevational view of one of the clip sections shown in FIG. 4A;

FIG. 4C is a side elevational view of a formed anchor clip from the clip section of FIG. 4B in accordance with the fourth embodiment of the present invention;

FIG. 4D is a side elevational view of another one of the clip sections shown in FIG. 4A;

FIG. 4E is a side elevational view of a formed anchor clip from the clip section of FIG. 4D in accordance with the fourth embodiment of the present invention;

FIG. 5 is a top view of the series of interconnected anchor clip sections shown in FIG. 4, with the inner and outer regions having their respective folding means interchanged from the position previously shown;

FIG. 5A is a view similar to FIG. 5 showing a lower cut out portion in the clip sections to form prongs for being driven into a furniture rail;

FIG. 5B is a side elevational view of one of the clip sections shown in FIG. 5A;

FIG. 5C is a side elevational view of a formed anchor clip from the clip section of FIG. 5B in accordance with the present invention;

FIG. 5D is a side elevational view of another one of the clip sections shown in FIG. 5A;

FIG. 5E is a side elevational view of a formed anchor clip from the clip section of FIG. 5D in accordance with the invention;

FIG. 6 is a top view of a series of interconnected anchor clip sections of the present invention wherein the left clip section is a variation of the third embodiment, the middle clip section is a variation of the fourth embodiment, and the right clip section is another variation of the fourth embodiment of the present invention;

FIG. 6A is a view similar to FIG. 6 showing a lower cut out portion in the clip sections to form prongs for being driven into a furniture rail;

FIG. 6B is a side elevational view of one of the clip sections shown in FIG. 6A;

FIG. 6C is a side elevational view of a formed anchor clip from the clip section of FIG. 6B in accordance with the invention;

FIG. 6D is a side elevational view of another one of the clip sections shown in FIG. 6A; and FIG. 6E is a side elevational view of a formed anchor clip from the clip section of FIG. 6D in accordance of the invention.

DETAILED DESCRIPTION OF THE PREFERRED EMBODIMENTS

As shown in FIGS. 1–1C, an anchor clip 10 of the present invention has a body 11 of metal material including a generally flat base portion 12 that includes a first end 12A and a second end 12B, a leg portion 14 integrally extending from said second end 12B in a direction normal to said base portion, and a spring supporting or reverse curved portion 16 integrally extending out from said first end 12A in a direction opposite to said leg portion, said curved portion 16 curving back over the base portion 16 and terminating in edge 17 to define a hook 18 which is lined interiorly with a liner 20. Other configurations of the clip 10 are also known and are within the purview of the present invention. The base portion 12 is provided with an indexing hole 36 which is used for guidance in moving the steel strip including clip sections from which the anchor clips are formed, through shape-forming dies (not shown). The leg portion 14 has a leg or prong comprised of parts 38 and 40 extending outwardly out of the surface 32. Holes 70 are provided to facilitate separating the clips. FIGS. 1B and 1C show that a plastic liner 20 is retained on the interior surface 18*i* of hook 18 to prevent squeaking of the clip during use. In the two variations of the first embodiment shown in FIG. 1, it is seen in the left and middle clip that liner 20 is retained therein by the combination of an upper raised detent 50 located at the outermost region 16A of the hook 16 that is located farthest from the base 12, and a plurality of liner holding members struck from the metal material of the clip body 11 in the form of semicircular prongs 52 located at the innermost region 16B of the hook 16, closest to the base 12. As shown, there are pairs of tabs or prongs 52 that are spaced laterally from each other across the width of the clip body 11. The liner is pushed or abutted up against the detent 50, while the prongs 52 are folded over and on top of the liner.

In a second variation to the embodiment just described, and also shown to the far right in FIG. 1, the semicircular prongs 52 are replaced with struck liner holding members in the form of squarely configured prongs 54, and they are to be folded over the plastic liner 20 for maintaining it in place.

A second embodiment is shown in FIG. 2, where it is seen that a plurality of semi-circular prongs 52 are located at the outermost region of the hook 16. At the innermost region of the hook 16 is located a detent 50. As mentioned above, the detent and the semi-circular prongs 52, hold the plastic liner 20 securely in place.

Also shown in FIG. 2 is a variation to the second embodiment depicting a plurality of squarely configured prongs 54 located at the outermost region of the hook 16. The plastic liner 20 is held in place underneath the squared prongs 54 and by the detent 50 at the innermost region.

FIG. 3 shows a third embodiment depicting a plurality of semi-circular prongs 52 located at both the outermost and innermost regions of the hook 16. The plastic liner 20 is maintained underneath the semi-circular prongs 52 when they are folded over the liner. The far right clip in FIG. 3 shows a variation of this embodiment wherein a plurality of squarely configured prongs 54 at the innermost and outermost regions of the hook 16, in contrast to the roundly configured prongs of the left and middle clips.

As shown in FIG. 4, a fourth embodiment of the present invention consists of struck liner holding members in the form of an elongate tab 90 located substantially along the entire innermost region of the hook 16. In other words, elongate tab 90 extends substantially for the entire width of the clip body 11. The plastic liner 20 is maintained in place under the folded tab 90 at that end. In one aspect of this embodiment, a detent 50 is located near the outermost region of the hook to hold the other end of the liner.

FIG. 4 also depicts another variation to the fourth embodiment with the middle clip showing semi-circular prongs 52 at the outermost region and the right clip showing squarely configured prongs 54 at the same outermost region. The plastic liner 20 is maintained in place when the respective prongs (52, 54) and tabs (90) are folded over and onto the liner 20.

FIG. 5 shows an arrangement similar to the arrangement of FIG. 4, except now, the respective positions of the detents and the tabs have reversed on their respective clips.

FIG. 6 shows a further variation to the third embodiment, wherein at the extreme left clip, a plurality of struck liner holding members in the form of pointed prongs 56 are located at both the outermost and innermost regions of the hook 16. The pointed prongs 56 may first pass through the liner before being folded over the liner 20 in order to maintain it in place. In a further variation of the second embodiment, detents 50 of the middle and far right clips may be located at either the outermost or innermost regions of the hook with pointed prongs 56 at the end opposing the detent end.

As the previously-described liner holding members 52, 54, 56 and 90 are struck from the metal material of the clip body 11, there will be through holes left in the clip body 11 under the liner holding members 52, 54, 56 and 90 when they are formed from the material of the body 11. Accordingly, when the plastic liner 20 is fed into the curved spring supporting portion 16 of the body 11 as by sliding or dropping it into place, the liner 20 will be disposed over these through holes. Thus, folding the holding members 52, 54, 56, or 90 down onto the liner 20 so as to clamp the liner in place will generally cause some sinking of the liner 20 into the through openings associated with respective ones of the folded over or clamped holding members so as to enhance the ability of the members to keep the liner 20 fixed and clamped against the spring supporting portion 16 without sliding thereof during use with flexing of the spring.

It will be understood that the invention may be embodied in other specific forms without departing from the spirit or central characteristics thereof. The present embodiments, therefor, are to be considered in all respects as illustrative and not restrictive, and the invention is not to be limited to the details given herein.

What is claimed is:

1. A clip for securing furniture springs to furniture rails, the clip comprising:

a body of metal material;

a generally flat base portion of the body for engaging a furniture rail;

a spring supporting portion of the body extending out from the base portion and curving back thereover to an edge thereof for maintaining a portion of a furniture spring in a substantially predetermined position relative to the furniture rail;

a plastic liner secured to the curved spring supporting portion of the body for engaging the spring portion to minimize squeaking caused by metal-to-metal contact between the curved spring supporting portion of the clip body and the spring portion; and at least one liner holding member struck from the metal material of the curved spring supporting portion of the body and spaced from the edge thereof for keeping the liner against the curved spring supporting portion of the clip body.

2. The clip of claim 1 wherein the at least one liner holding member comprises a pair of struck liner holding members spaced laterally from each other across the clip body.

3. The clip of claim 1 wherein the at least one liner holding member is formed adjacent one of the flat base portion and the edge of the spring supporting portion, and a raised detent adjacent the other one of the flat base portion and the edge of the spring supporting portion with the liner clamped by the holding member and abutted against the raised detent to fix the liner on the curved spring supporting portion of the body.

4. The clip of claim 1 wherein the liner holding member comprises a prong having a pointed end for piercing the liner.

5. The clip of claim 1 wherein the struck liner holding member comprises at least one tab.

6. The clip of claim 5 wherein the at least one tab comprises a pair of tabs spaced laterally from each other across the body of the clip.

7. The clip of claim 6 wherein the pair of the tabs have one of a circular and a square configuration.

8. The clip of claim 5 wherein the at least one tab comprises a single elongate tab extending laterally for substantially the entire width of the clip body.

9. The clip of claim 1 wherein the spring supporting portion includes an opening in the metal material thereof below the liner holding member.

* * * * *